US010399743B1

(12) United States Patent
Loritz

(10) Patent No.: US 10,399,743 B1
(45) Date of Patent: Sep. 3, 2019

(54) CONTAINER WITH SILICONE INSERT COMPARTMENT AND SEGREGATED STORAGE REGION

(71) Applicant: Kenneth Anthony Loritz, Irvine, CA (US)

(72) Inventor: Kenneth Anthony Loritz, Irvine, CA (US)

( * ) Notice: Subject to any disclaimer, the term of this patent is extended or adjusted under 35 U.S.C. 154(b) by 527 days.

(21) Appl. No.: 15/092,105

(22) Filed: Apr. 6, 2016

Related U.S. Application Data

(60) Provisional application No. 62/145,124, filed on Apr. 9, 2015.

(51) Int. Cl.
*B65D 51/00* (2006.01)
*B65D 21/02* (2006.01)

(52) U.S. Cl.
CPC .... *B65D 21/0233* (2013.01); *B65D 2251/205* (2013.01)

(58) Field of Classification Search
CPC ..... B65D 21/00; B65D 21/02; B65D 21/0233
USPC .... 220/504, 501, 503, 523, 527–528, 23.87, 220/23.86, 23.83, 837; 206/514
See application file for complete search history.

(56) References Cited

U.S. PATENT DOCUMENTS 342,397 A * 5/1886 Smith ..... F25D 31/002 62/319
3,519,005 A * 7/1970 Krezanoski ..... A45C 11/005 134/143
5,657,894 A * 8/1997 Bowen ..... B65D 43/169 220/254.3
6,105,812 A * 8/2000 Riordan ..... B65D 1/04 215/6
6,367,409 B1 * 4/2002 Broom ..... A23G 3/26 118/13
6,427,863 B1 * 8/2002 Nichols ..... A47J 39/00 220/23.86
7,287,656 B2 * 10/2007 Guilford, III ..... A61J 9/00 215/11.1
8,225,955 B2 * 7/2012 Moskow ..... B65D 83/0011 206/581
9,169,043 B2 * 10/2015 Witkowski ..... B65D 25/00
2010/0078436 A1 * 4/2010 Winchell ..... B65D 1/04 220/504

(Continued)

*Primary Examiner* — Robert Poon
(74) *Attorney, Agent, or Firm* — Fay Sharpe LLP

(57) ABSTRACT

A container assembly includes a container body enclosing a cavity, and first and second openings in the body that communicate with the cavity. A compartment is dimensioned for receipt through the first opening into the body cavity and partially fills the body cavity. The compartment housing is formed of a pliable, fluid sealable material open at a first end, and the housing receives a closure member also formed of a pliable, fluid sealable material to form a fluid-tight connection with the first end of the housing. The compartment includes an external shoulder dimensioned that limits further advancement of the compartment through the first opening and into the body cavity. A cap is dimensioned for receipt over the first opening of the body to selectively open and close access to the body cavity, and access to the compartment. A plug member is dimensioned for operative engagement with the second opening of the body for selectively opening and closing access to the body cavity.

20 Claims, 9 Drawing Sheets

(56) References Cited

U.S. PATENT DOCUMENTS

| | | | | |
|---|---|---|---|---|
| 2010/0224646 | A1* | 9/2010 | Incorvia | B29C 45/0081 220/839 |
| 2010/0237079 | A1* | 9/2010 | Sharon | B65D 25/08 220/502 |
| 2011/0052459 | A1* | 3/2011 | Shibata | B65D 47/06 422/500 |
| 2015/0099044 | A1* | 4/2015 | Bowa | B65D 81/261 426/397 |
| 2015/0122811 | A1* | 5/2015 | Tamaro | B65D 25/18 220/23.89 |
| 2015/0239612 | A1* | 8/2015 | Wang | B65D 81/3216 220/23.89 |

* cited by examiner

CONTAINER WITH SILICONE INSERT COMPARTMENT AND SEGREGATED STORAGE REGION

This application claims the priority benefit of U.S. Provisional Application No. 61/145,124, filed on Apr. 9, 2015, the disclosure of which is incorporated herein by reference.

BACKGROUND

The present disclosure relates to packaging, and specifically a storage container or jar. More particularly, the storage container has improved functionality and versatility that allows separate items to be stored in a single container.

It is common to provide a container that holds a desired item or substance. However, there is an increasing need to provide a versatile, multi-function container that addresses requirements desired by end users. For example, it is desirable to provide storage for different types of items having disparate requirements for storage, e.g., one item may require a fluid-tight compartment while the other item does not, or the two items may be significantly differently sized, or the two items may not be compatible with one another.

On the other hand, the design must be capable of meeting these needs but at a reasonable cost and ease of manufacturing. Although technically advanced manufacturing techniques permit a number of complex designs, such techniques must be offset by the associated cost. Accordingly, simple, easy to use designs must likewise be relatively simple and inexpensive to manufacture or else the design is impractical.

A need exists for a container that meets these needs and others in an efficient, economical manner.

SUMMARY

A container assembly includes a container body enclosing a cavity, and first and second openings in the body that communicate with the cavity. A shoulder extends inwardly from the body into the cavity and is spaced from the first opening. A compartment is dimensioned for receipt through the first opening into the body cavity and partially fills the body cavity when received therein. The compartment has a housing formed of a pliable, fluid sealable material open at a first end, and the housing receives a closure member also formed of a pliable, fluid sealable material that is dimensioned to form a fluid-tight connection with the first end of the housing. The compartment includes an external shoulder that limits further advancement of the compartment through the first opening and into the body cavity. A cap is dimensioned for operative engagement with the first opening of the body to selectively open and close access to the body cavity, and access to the compartment. A plug member is dimensioned for operative engagement with the second opening of the body for selectively opening and closing access to the body cavity via the second opening.

The compartment, and that portion of the container body not filled by the compartment, form distinct, segregated, first and second storage regions.

Benefits and advantages of the present disclosure will become more apparent from reading and understanding the following detailed description.

DETAILED DESCRIPTION

Figure 1:
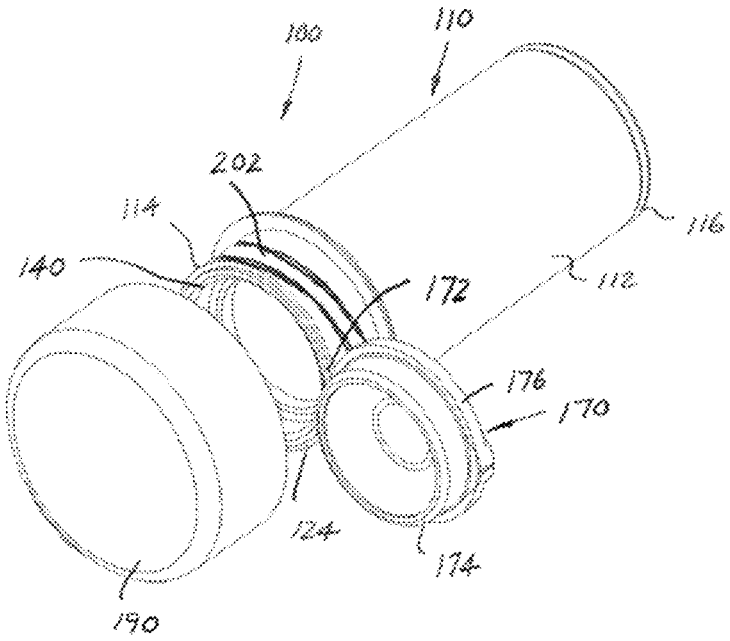
FIG. 1 is a perspective view of the container assembly with the cap removed from the container body and the closure member of the compartment in an open position.
Figure 2:
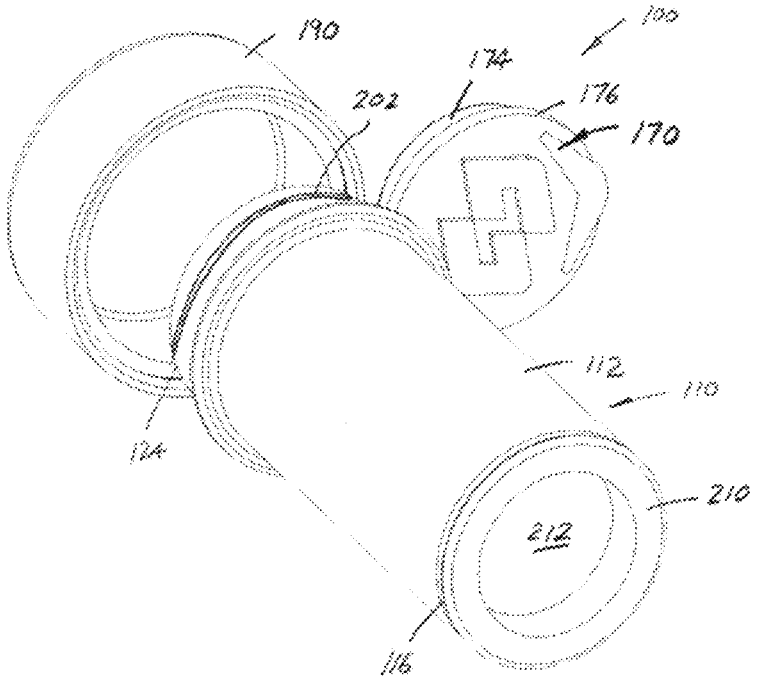
FIG. 2 is a perspective view of the container assembly of FIG. 1 taken from the opposite end.
Figure 3:
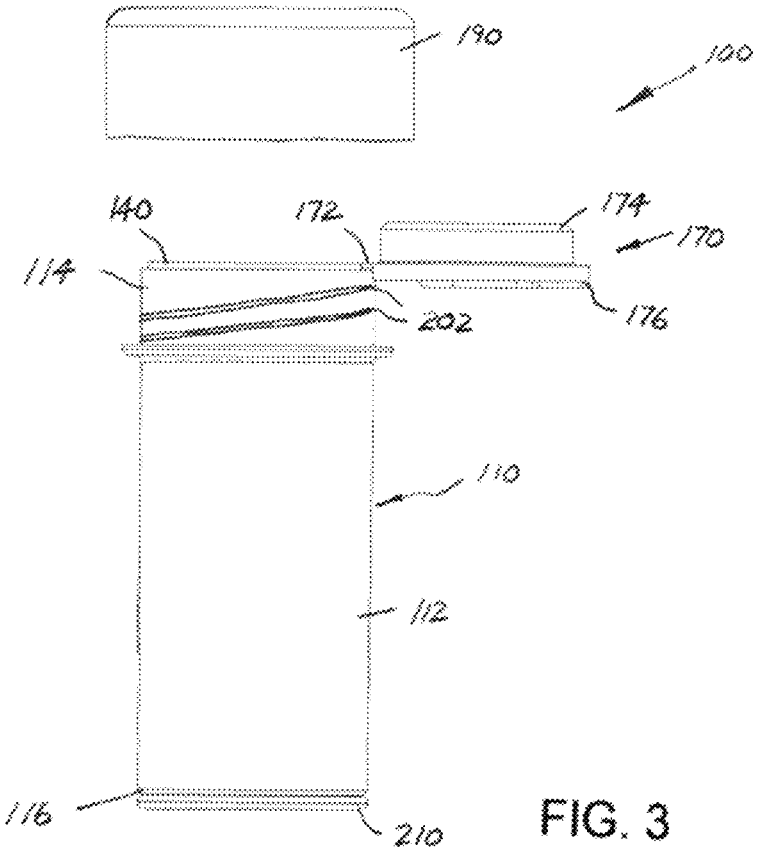
FIG. 3 is a front elevational view of the container assembly of FIG. 1.

Turning to the Figures, there is shown a container assembly 100 of the present disclosure. The container assembly 100 includes a generally cylindrical, open ended container body 110 that includes a sidewall 112 and a first or upper end 114 and a second or lower end 116. In the illustrated embodiment of FIGS. 1-3, the sidewall 112 has substantially constant inner and outer dimensions (i.e., and a substantially constant sidewall thickness) as it extends longitudinally from the upper end 114 to the lower end 116. Of course one skilled in the art will recognize that the constant inner and outer dimensions, as well as the sidewall thickness need not necessarily be required.

Figure 4:
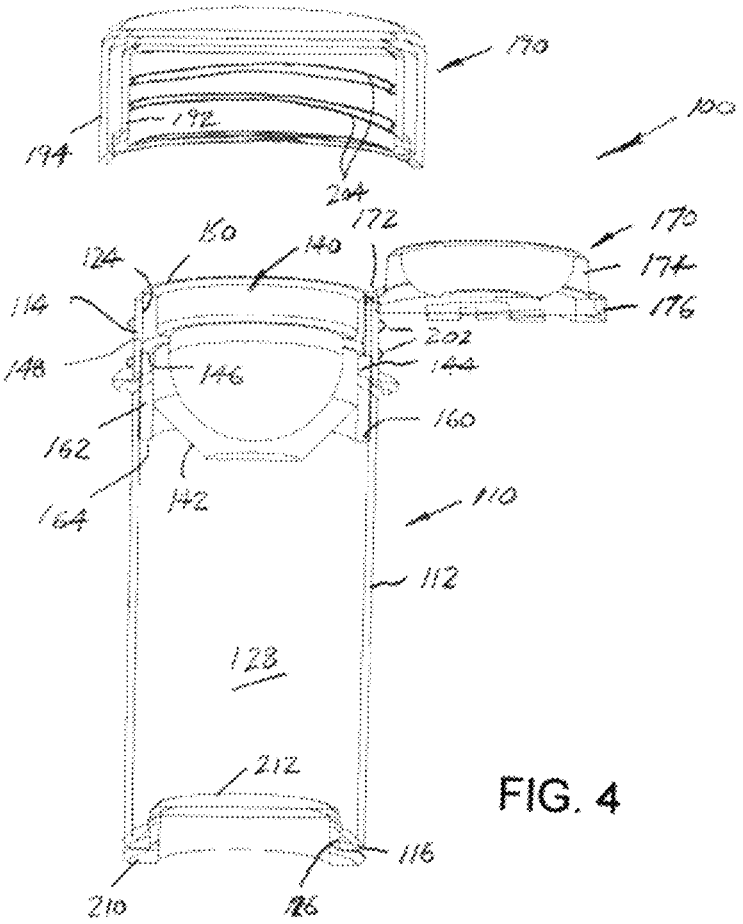
FIG. 4 is a longitudinal, cross-sectional view of the container assembly of FIG. 3.
Figure 5:
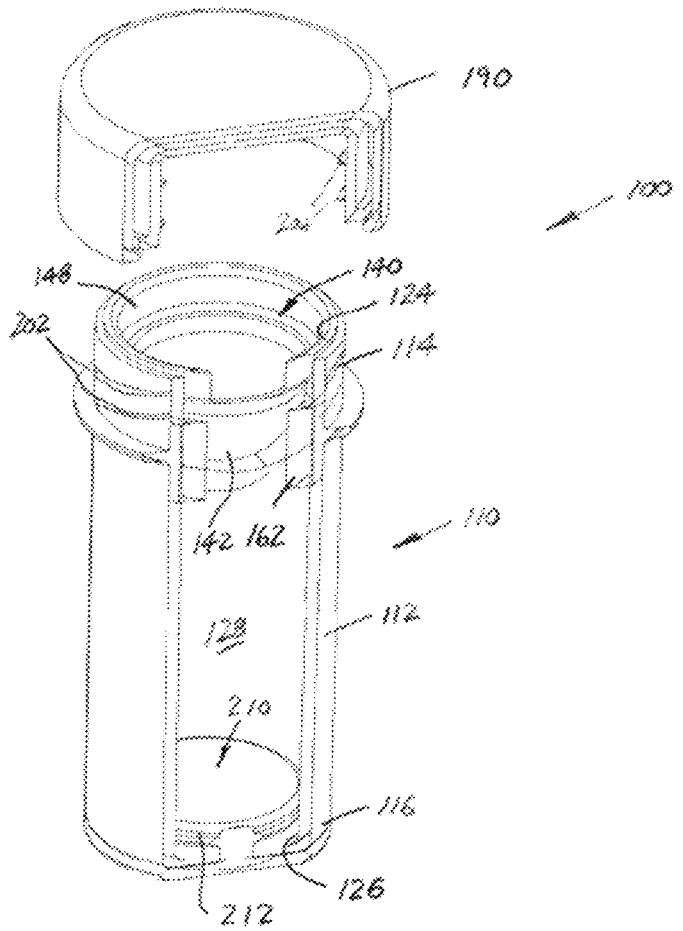
FIG. 5 is a perspective view shown partially in cross-section.
Figure 6:
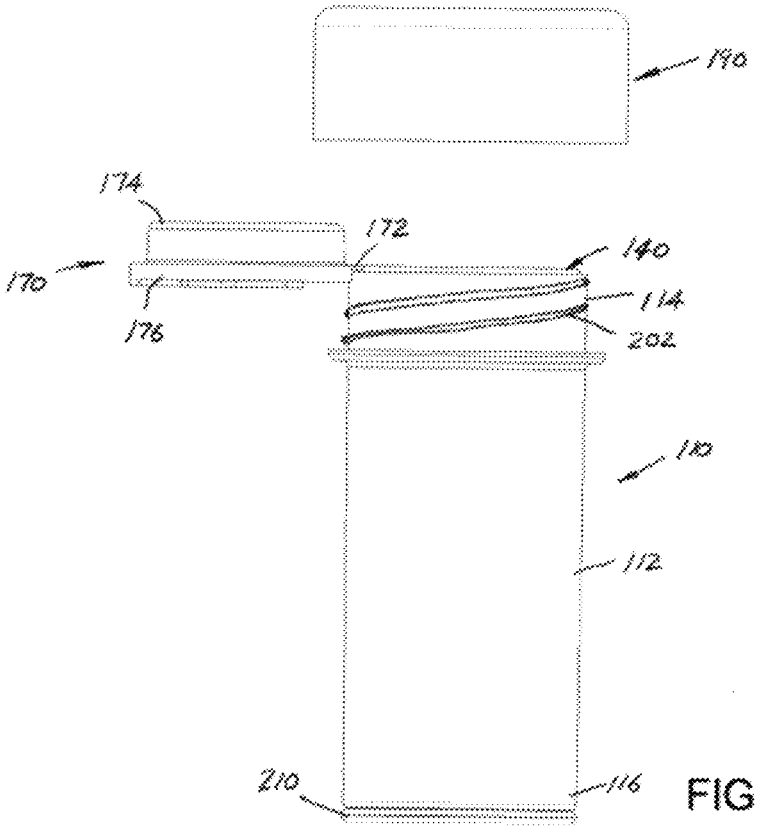
FIG. 6 is a rear elevational view of the container assembly of FIG. 1.
Figure 7:
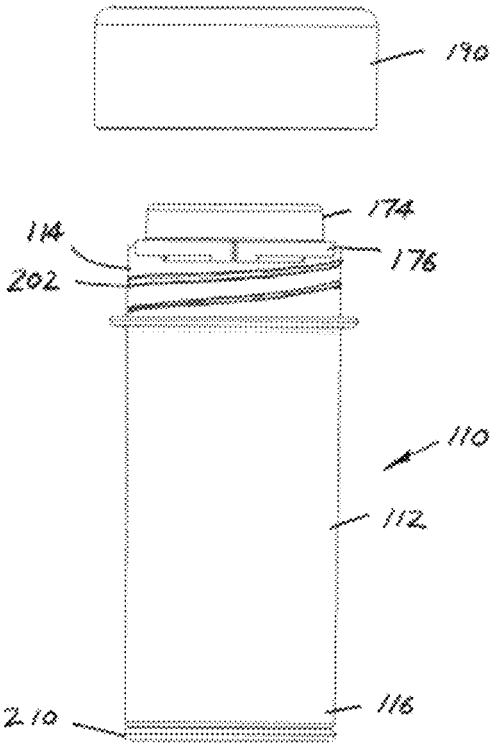
FIG. 7 is a side elevational view of the container assembly of FIG. 1.
Figure 8:
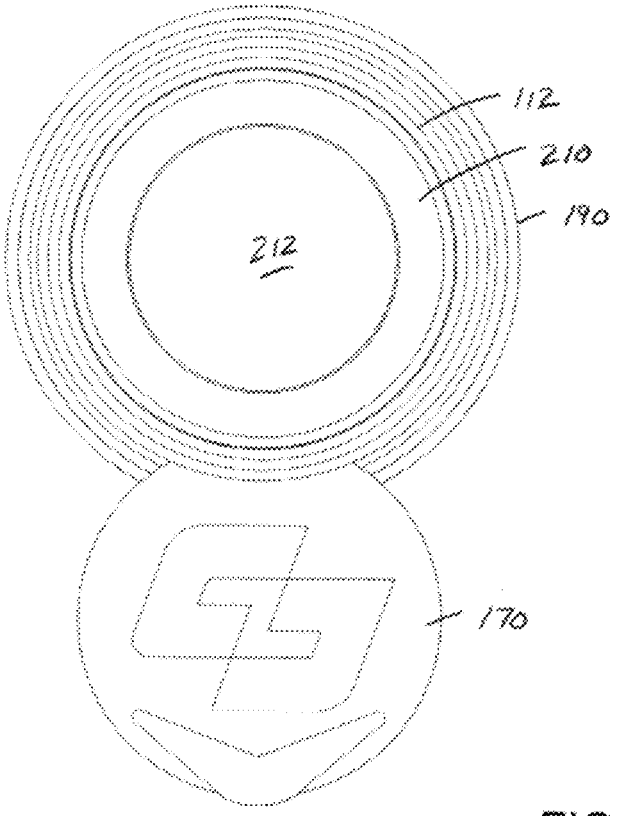
FIG. 8 is a top plan view of the container assembly.
Figure 9:
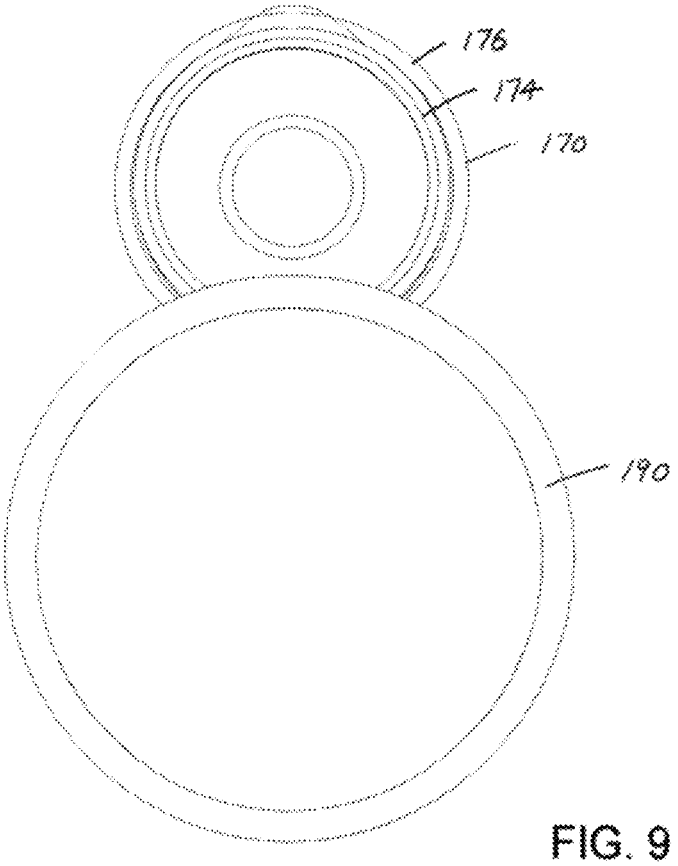
FIG. 9 is a bottom plan view of the container assembly.

Each of the upper and lower ends 114, 116 has an opening, namely a first or upper opening 124 (FIG. 4) and a second or lower opening 126, respectively. In the illustrated example, the upper opening 124 of the container body is larger than the lower opening 126, although again this need not necessarily be the case. Each of the openings 124, 126 communicate with an interior cavity 128 of the container body 112 (FIGS. 4 and 5). In the preferred arrangement, the container body 112 is a rigid polymer, preferably rigid polypropylene.

The body cavity 128 is divided or segregated into first and second portions by a compartment, specifically a compartment housing 140. The compartment housing 140 is at least partially received into the upper end 114 of the container body 110 through the upper opening 124. The compartment housing 140 is formed of a pliable, fluid sealable polymer material, specifically a silicone material. In this manner, the silicone material of the compartment housing 140 forms a fluid-tight engagement along surfaces that the silicone material abuttingly engages, such as along the inner surface of the sidewall 112, particularly along the upper end 114. A lower end of the compartment housing 140 has a tapering conformation 142 that merges into a generally constant dimension portion 144, and that forms a step or shoulder 146, which then leads into a generally constant dimension region 148. An upper, terminal end 150 of the compartment housing 140 is brought substantially flush with the terminal edge of the container body upper end 114.

To prevent over-insertion of the compartment housing 140 into the container body 112, an internal shoulder or ledge 160 is formed in the sidewall 112. In addition, a rigid, annular insert 162 (preferably a rigid polyethylene, for example) is axially advanced through the upper opening 124 at the upper end 114 of the container body 110. The insert 162 is dimensioned so that the first or inner end 164 rests on the shoulder 160 of the container body 110 and prevents further axial advancement of the insert into the container body. Once the insert 162 is received in the container body 110, the compartment housing 140 is likewise advanced through the upper opening 124 at the upper end 114 of the container body. The tight dimensional fit between the outer surface of the silicone compartment housing 140 forms a fluid tight seal with the insert along region 144, and also forms a fluid tight seal with the inner surface of the compartment body 110 at the upper end 114. As noted above, the compartment housing 140 is dimensioned for advancement until the upper terminal end 150 of the compartment housing is substantially flush with the terminal edge of the upper end 114 of the container body 110.

The compartment housing 140 includes a closure member 170 also formed of a pliable, fluid sealable material that is dimensioned to form a fluid-tight connection with the upper, open end of the compartment housing. If desired, the closure member 170 is connected via hinge 172 with the compartment housing 140. The closure member 170 includes an insertion portion 174 that is received in the upper, open end of the compartment housing 140 an an outer surface of the insertion portion sealingly engages an interior surface of the compartment housing. In addition, a radially extending flange 176 is dimensioned for closing receipt over the compartment housing 140 and the upper end 114 of the container body 110.

A cap 190 is a conventional tamperproof arrangement having an inner portion 192 that is received within an outer shell 194. Thread portions 202 on the upper end 114 of the container body 110 cooperate with internal threads 204 to rotate the cap 190 into closed arrangement with the container body. As will be appreciated, with the closure member 170 in a closed position whereby the flange 176 thereof extends over and engages the upper terminal end 150 of the compartment housing 140 and also over the terminal end of the container body, a downward force imposed on the flange by threadably closing the cap on the container exerts additional downward sealing pressure on the closure member to create a secure, sealing interfit with the compartment housing, and bottoms out against the upper terminal end of the container body.

The silicone material that forms the compartment housing 140 and the closure member 170 allows for a fluid-type substance or material to be stored in the compartment housing. The remainder of the cavity 128 in the container housing 110 (i.e., between the compartment housing and the opening 126) is therefore adapted to receive other materials or components therein. A plug member 210 includes a central extending portion 212 dimensioned for receipt through the opening 126 in the lower end 116 of the container body. The plug member 210 and the lower end 116 of the container body provide for a snap-fit connection that assures retention of material or components received in the cavity 128, and that need not necessarily be required as a fluid sealing fit.

With the compartment housing 140 received in the upper end 114 of the container body 110, the interior cavity 128 is divided into two, distinct storage regions. That is, the insert 162 provides an interference fit with the external surface of the compartment housing 140 so that the compartment housing is not inadvertently removed from the container body 110. The closure member 170 (and also cap 190) assures that material/items stored in the compartment housing 140 (the first storage region) are sealed from the external environment, and also from materials/items stored in a remainder of the cavity 128 of the container body 110 (i.e., the second storage region). In addition, access to the second storage region is still provided by removing the plug member 210 from the second opening 126 in the lower end 116 of the container body 110—and without requiring removal of the cap 190 to access this region.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A container assembly comprising:

a container body enclosing a cavity, and having first and second openings therein that communicate with the cavity, a shoulder extending inwardly from the body into the cavity and spaced from the first opening;

a compartment dimensioned for receipt through the first opening into the body cavity and partially filling the body cavity when received therein, the compartment having a housing formed of a pliable, fluid sealable material open at a first end, and that receives a closure member also formed of a pliable, fluid sealable material that is dimensioned to form a fluid-tight connection with the first end of the housing, the compartment including an external shoulder dimensioned for limiting further advancement of the compartment through the first opening and into the body cavity;

a rigid insert having a first end with a first opening that receives a portion of the compartment therein, and a second end with a second opening that allows a reduced dimension portion of the compartment to extend therethrough, wherein the rigid insert has an outer dimension such that one end thereof abuts the shoulder of the body and precludes further insertion of the insert and compartment in a direction from the first opening in the body toward the second opening in the body;

a cap dimensioned for operative engagement with the first opening of the body to selectively open and close access to the body cavity, and access to the compartment such that the cap simultaneously closes both the container body and the compartment when received over the first opening; and a plug member dimensioned for operative engagement with the second opening of the body for selectively opening and closing access to the body cavity.

2. The container assembly of claim 1 wherein the container body is a rigid polymer material.

3. The container assembly of claim 2 wherein the container body is a polypropylene.

4. The container assembly of claim 3 wherein the compartment is a pliable polymer material.

5. The container assembly of claim 4 wherein the compartment is a silicone material.

6. The container assembly of claim 4 further comprising a rigid insert having a first end with a first opening that receives a portion of the compartment therein, and a second end with a second opening that allows a reduced dimension portion of the compartment to extend therethrough.

7. The container assembly of claim 6 wherein the rigid insert has an outer dimension such that one end thereof abuts the body shoulder and precludes further insertion of the insert and compartment in a direction from the first opening in the body toward the second opening in the body.

8. The container assembly of claim 1 wherein the closure member is connected via a hinge to the compartment housing.

9. The container assembly of claim 1 wherein a flange portion of the closure member is dimensioned for abutting engagement with the first end of the compartment.

10. The container assembly of claim 9 wherein the flange portion of the closure member has a dimension greater than the first opening in the body for closing receipt on the container body.

11. A container assembly comprising:

a container body enclosing a cavity, and having first and second openings therein that communicate with the cavity, a shoulder extending inwardly from the body into the cavity and spaced from the first opening;

a compartment dimensioned for receipt through the first opening into the body cavity and partially filling the body cavity when received therein, the compartment having a housing formed of a pliable, fluid sealable material open at a first end, and that receives a closure member also formed of a pliable, fluid sealable material that is dimensioned to form a fluid-tight connection with the first end of the housing, the compartment including an external shoulder dimensioned for limiting further advancement of the compartment through the first opening and into the body cavity, and wherein a flange portion of the closure member is radially dimensioned for abutting engagement with the first end of the compartment and for closing receipt on the container body;

a cap dimensioned for operative engagement with the first opening of the body to selectively open and close access to the body cavity, and access to the compartment; and a plug member dimensioned for operative engagement with the second opening of the body for selectively opening and closing access to the body cavity, wherein the flange portion of the closure member is engaged by an underside of the cap when the cap closes the first end of the container body.

12. The container assembly of claim 11 wherein the cap and container body include cooperating thread portions.

13. The container assembly of claim 12 wherein the plug member and the second opening in the container include respective interlock structures for selectively joining the plug member to the container.

14. The container assembly of claim 1 wherein the body has a cylindrical configuration.

15. The container assembly of claim 11 wherein the body has an external thread portion that cooperates with an internal thread portion of the cap.

16. The container assembly of claim 11 further comprising a rigid insert having a first end with a first opening that receives a portion of the compartment therein, and a second end with a second opening that allows a reduced dimension portion of the compartment to extend therethrough.

17. The container assembly of claim 16 wherein the rigid insert has an outer dimension such that one end thereof abuts the body shoulder and precludes further insertion of the insert and compartment in a direction from the first opening in the body toward the second opening in the body.

18. The container assembly of claim 17 wherein the rigid insert and body are both formed of a rigid, polypropylene material.

19. The container assembly of claim 18 wherein the compartment is formed of a pliable polymer material.

20. The container assembly of claim 19 wherein the compartment is formed of a silicone material.

* * * * *